US009067769B2

(12) United States Patent
Huang

(10) Patent No.: US 9,067,769 B2
(45) Date of Patent: Jun. 30, 2015

(54) SOUNDLESS WINCH

(71) Applicant: KOU SHENG FENG CO., LTD., Miaole (TW)

(72) Inventor: Yu-Ta Huang, Miaole (TW)

(73) Assignee: Kou Sheng Feng Co., Ltd., Miaole (TW)

( * ) Notice: Subject to any disclaimer, the term of this patent is extended or adjusted under 35 U.S.C. 154(b) by 142 days.

(21) Appl. No.: 14/012,989

(22) Filed: Aug. 28, 2013

(65) Prior Publication Data

US 2015/0060747 A1 Mar. 5, 2015

(51) Int. Cl.
*B66D 5/02* (2006.01)
*B66D 1/04* (2006.01)

(52) U.S. Cl.
CPC ..... *B66D 1/04* (2013.01)

(58) Field of Classification Search
CPC ..... B66D 1/04; B66D 1/06; B66D 1/7468; B66D 3/02; B66D 1/14
USPC ..... 254/266, 329, 375
See application file for complete search history.

(56) References Cited

U.S. PATENT DOCUMENTS 2,590,610 A * 3/1952 Grosch ..... 254/344
3,265,361 A * 8/1966 Mayrath ..... 254/376
3,915,432 A * 10/1975 Bustamante ..... 182/239
4,171,796 A * 10/1979 Forbush ..... 242/388.3
4,236,694 A * 12/1980 Kristensson ..... 254/365
4,391,432 A * 7/1983 Baud ..... 254/365
4,456,227 A * 6/1984 Notenboom ..... 254/350
4,544,136 A * 10/1985 Denman et al. ..... 254/323
5,607,143 A * 3/1997 Regal ..... 254/342
6,390,452 B1 * 5/2002 Dobmeier et al. ..... 254/323
2005/0229957 A1 * 10/2005 Glatz ..... 135/20.3
2009/0188417 A1 * 7/2009 VanScoyoc ..... 114/210
2010/0133372 A1 * 6/2010 Ying ..... 242/395
2011/0062273 A1 * 3/2011 Guyard ..... 242/395
2013/0270498 A1 * 10/2013 Burneister et al. ..... 254/266

* cited by examiner

*Primary Examiner* — Emmanuel M Marcelo
(74) *Attorney, Agent, or Firm* — Leong C. Lei

(57) ABSTRACT

A soundless includes a body, which is a hollow cylinder that has an end forming a flange, is provided, at each of ends thereof, with a stepped section, and receives a bearing, a one-way bearing, and a friction ring therein; a reel, which has two ends each forming a stop flange, a threaded rod projecting from a center of one of the ends of the reel and having an end forming a fitting hole, the reel being received, with the threaded rod thereof, in the hollow cylinder of the body in such a way that the threaded rod of the reel is exposed outside the body to allow the bearing, the one-way bearing, and the friction ring to couple to the reel; and a handle, which is fit to the threaded rod of the reel that is exposed outside the body by a pin fit in the fitting hole.

5 Claims, 4 Drawing Sheets

SOUNDLESS WINCH

TECHNICAL FIELD OF THE INVENTION

The present invention generally relates to a winch, and more particularly to a soundless winch suitable for lifting and pulling a yacht, a water scooter, or other heavy objects.

DESCRIPTION OF THE PRIOR ART

A winch mechanism provides a winding function for winding up a rope and is commonly used in the installation of a tennis net and a pulling and towing device for yachts and automobiles, showing an extremely wide range of application. A conventional winch is shown in Taiwan Utility Model M423691, which discloses a "winch mechanism" that comprises a base comprising a bottom plate and two side plates; two positioning holes, which are respectively formed at predetermined locations in the two side plates of the base; a rotation shaft, which has two ends respectively in the two positioning holes in a rotatable manner and a shaft body forming a mounting section; a driven gear train, which has at least one side at which a toothed disk is arranged and a middle where a fixing shaft assembled between the two side plates at a rear portion of the base to show a rotatable configuration, a rope winding section being formed between two toothed disks of the driven gear train; an assembled movement-guiding gear train, which is assembled to the rotation shaft by being mounted to the mounting section of the rotation shaft to be synchronously driven to rotate, the assembled movement-guide gear train comprising at least one gear and a space keeping element at the center, the gear mating the toothed disks of the driven gear train so that the assembled movement-guide gear train is allowed to drive the driven gear train; and a rotating handle, which is mounted to an end of the rotation shaft so that the rotating handle can be rotated to drive the rotation shaft to rotate.

Although the above-descried structure provides an effect of enhancing concentricity among various component, sounds may be generated by the clicking movement between a pawl and a ratchet wheel. This is noisy and further improvement is desired.

In light of the above, the present invention aims to provide a soundless winch that is quiet and soundless, and gives off no noise during the operation thereof.

SUMMARY OF THE INVENTION

The primary object of the present invention is to provide a soundless winch that is quiet and soundless and gives off no noise during the operation thereof.

To achieve the above object, the present invention provides a soundless winch, which comprises: a body, which is a hollow cylinder having an end on which a flange is formed, the hollow cylinder being provided, at each of the front and rear ends thereof, with a stepped section adjacent to the end, the body receiving a bearing, a one-way bearing, and a friction ring to fit therein; a reel, which has two ends each forming a stop flange, a threaded rod projecting from a center of one of the ends of the reel, the threaded rod having an end forming a fitting hole, the reel being received, with the threaded rod thereof, in the hollow cylinder of the body in such a way that the threaded rod of the reel is exposed outside the body to allow the bearing, the one-way bearing, and the friction ring to couple to the reel; and a handle, which is fit to the threaded rod of the reel that is exposed outside the body by a pin fit in the fitting hole so that forward or reverse rotation of the handle controllably sets the friction ring and the one-way bearing in a released condition or a braking condition.

In the above-described soundless winch, the reel comprises a coupling opening formed therein to receive a rope to attach thereto.

In the above-described soundless winch, the one-way bearing that is received in the body has front and rear ends to each of which a composite copper plate is attached for use in a wet manner.

In the above-described soundless winch, the one-way bearing that is received in the body has front and rear ends each provided with an oil seal for corrosion protection.

In the above-described soundless winch, an end of the reel that does not comprise the threaded rod is provided with a coupling section for coupling a retention plate that comprises a bearing.

Compared to the prior art, the present invention provides prominent advantages as follows:

(1) A one-way bearing is used in combination with a friction ring to allow the winch to operate in soundless manner in pulling a rope or cable.

(2) With the combination of a one-way bearing and a friction used in the present invention, the wind can be operated in a soundless manner.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The embodiments of the present invention are a bone connection material. To make those skilled in the art to undoubtedly understand the embodiments, the structures of the bone connection materials will be described first. The materials and types of filaments that are used in the embodiments will then be discussed.

Figure 1:
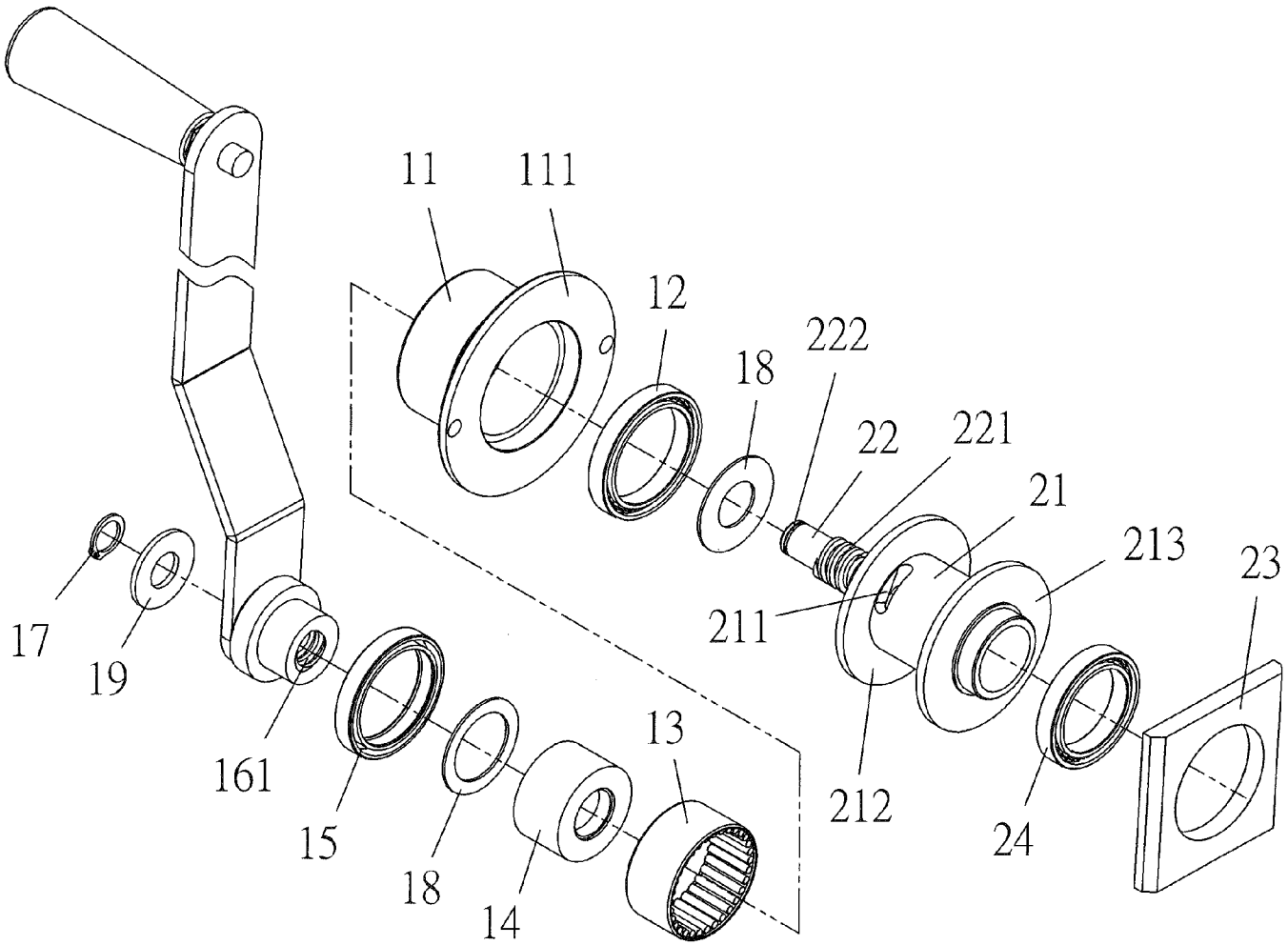
FIG. 1 is an exploded view of an embodiment of the present invention.
Figure 2:
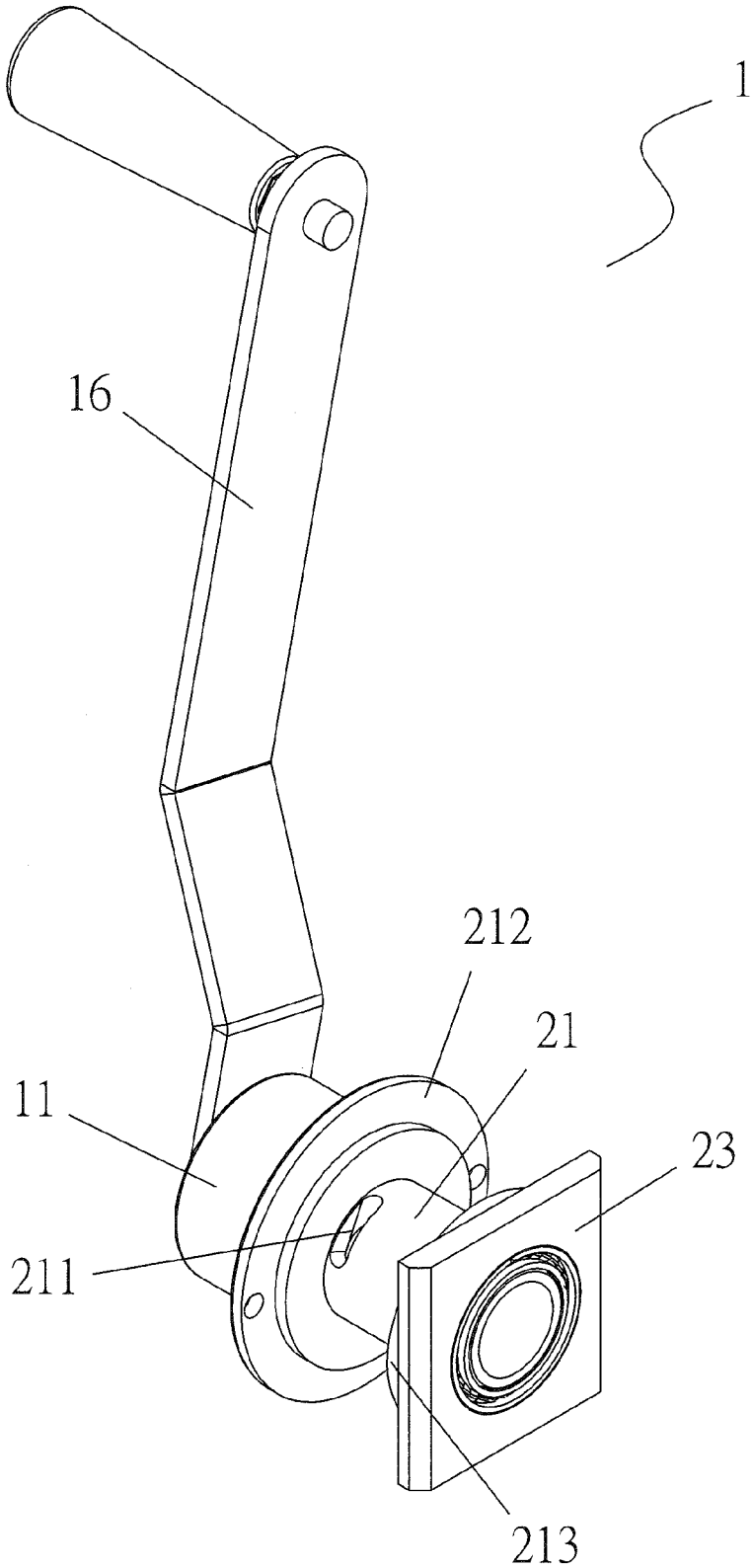
FIG. 2 is a perspective view of the embodiment of the present invention.

Referring collectively to FIGS. 1 and 2, the present invention provides a soundless winch 1, which comprises: a body 11, which is a hollow cylinder having an end on which a flange 111 is formed, the hollow cylinder being provided, at each of the front and rear ends thereof, with a stepped section adjacent to the end, the body 11 receiving a bearing 12, a one-way bearing 13, and a friction ring 14 to fit therein; a handle 16, which is provided with a thread 161; a reel 21, which has two ends each forming a stop flange 212, 213, the reel 21 being provided with a coupling opening 211 between the two stop flanges 212, 213, a threaded rod 22 projecting from a center of one of the ends of the reel 21, the threaded rod 22 having a front end forming a thread 221 and a rear end forming a fitting hole (a clip groove) 222, the reel 21 being received, with the threaded rod 22 thereof, in the hollow cylinder of the body 11 in such a way that an end of the threaded rod 22 of the reel 21 is exposed outside the body 11, a composite copper plate 18 being arranged between the handle 16 and the reel 21 to securely position the friction ring 14 and to have the one-way bearing 13 and the friction ring 14 and the reel 21 coupled to each other; and a handle 16, which is fit to the threaded rod 22 of the reel 21 that is exposed outside the body 11 by a washer 19 and a pin (a clip ring) 17 fit in the fitting hole (the clip groove) 222 of the threaded rod 22.

Figure 3:
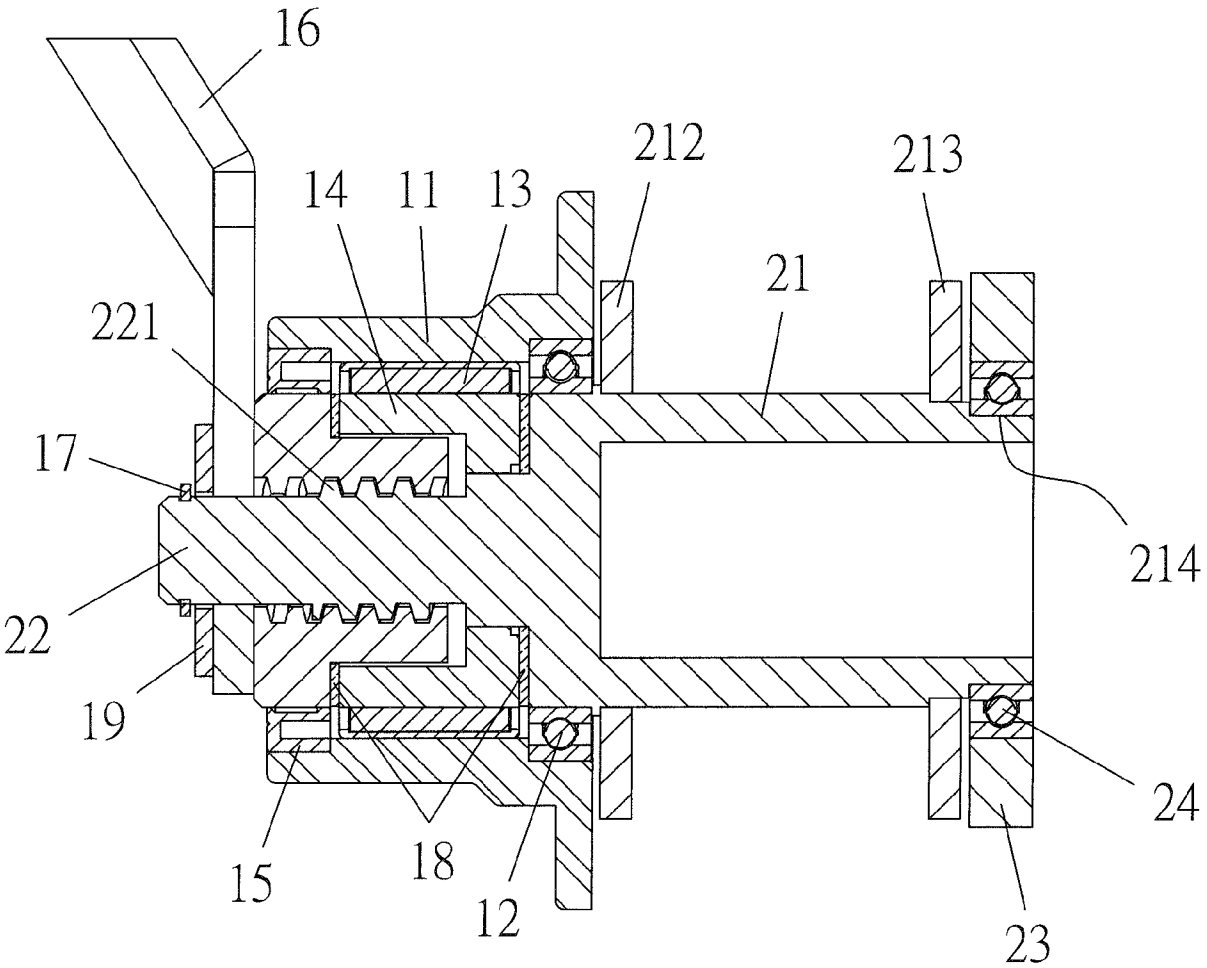
FIG. 3 is a cross-sectional view of the embodiment of the present invention in an assembled form.
Figure 4:
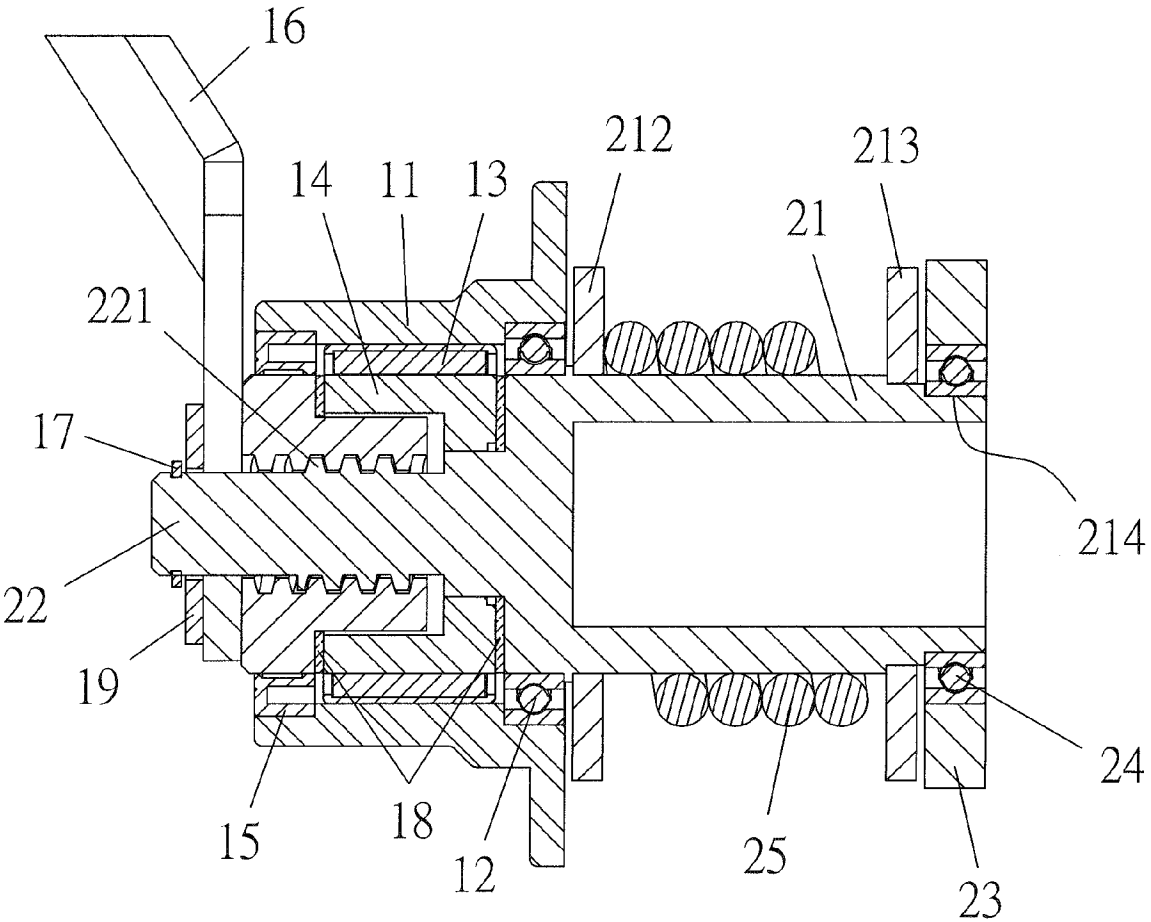
FIG. 4 is a schematic view illustrating an operation of the embodiment of the present invention.

Further, referring to FIG. 3, according to the present invention, the one-way bearing 13 has front and rear ends to each of which a composite copper plate 18 is attached so as to facilitate the soundless winch 1 to be used in a wet manner or alternatively, the front and rear ends of the one-way bearing 13 are each provided with oil seal 15 for corrosion protection. Further, the end of the reel 21 that does not comprise the threaded rod 22 is provided with a step-like coupling section 214 for coupling a retention plate 23 that comprises a bearing 24. As such, when the handle 16 is rotated in a forward direction, the friction ring 14 that is fit over the threaded rod 22 is caused to rotate along the one-way bearing 13 so that the reel 21 that is integral with the threaded rod 22 is caused to rotate in synchronization therewith. Thus, as shown in FIG. 4, a rope 25 that is fixed to the coupling opening 211 of the reel 21 is wound around the reel 21. When the handle 16 stops rotating, the friction ring 14 that is coupled to the threaded rod 22 is in "biting" engagement with the one-way bearing 13 and is stopped for further rotation so as to restrain the rope 25. To release the rope 25, the handle 16 is rotated in a reversed direction to induce a gap between the friction ring 14 and the composite copper plate 18 and thus not in a biting engagement so as to allow the threaded rod 22 to rotate reversely. As such, the rope 25 that is wound around the reel 21 is released. This arrangement allows the soundless winch 1 not to produce noisy sound in the operation thereof.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A soundless winch, comprising:

a body, which is a tubular cylinder having an end on which a flange is formed, the tubular cylinder being provided, at each of front and rear ends thereof, with a stepped section adjacent to the ends, the body receiving a bearing, a one-way bearing, and a friction ring to fit therein;

a reel, which has two ends each forming a stop flange, a threaded rod projecting from a center of one of the ends of the reel, the threaded rod having an end forming a fitting hole, the reel being received, with the threaded rod thereof, in the hollow cylinder of the body in such a way that the threaded rod of the reel is exposed outside the body to allow the bearing, the one-way bearing, and the friction ring to couple to the reel; and a handle, which is fit to the threaded rod of the reel that is exposed outside the body by a pin fit in the fitting hole so that forward or reverse rotation of the handle controllably sets the friction ring and the one-way bearing in a released condition or a braking condition.

2. The soundless winch according to claim 1, wherein the reel comprises a coupling opening formed therein to receive a rope to attach thereto.

3. The soundless winch according to claim 1, wherein the one-way bearing that is received in the body has front and rear ends to each of which a composite copper plate is attached for use in a wet manner.

4. The soundless winch according to claim 1, wherein the one-way bearing that is received in the body has a front end provided with an oil seal for corrosion protection.

5. The soundless winch according to claim 1, wherein an end of the reel that does not comprise the threaded rod is provided with a coupling section for coupling a retention plate that comprises a bearing.

* * * * *